US005587777A

United States Patent [19]

Miyaji et al.

[11] Patent Number: 5,587,777

[45] Date of Patent: Dec. 24, 1996

[54] DEVELOPING UNIT HAVING INTERLOCKING MECHANISM

[75] Inventors: Takashi Miyaji; Yoshikazu Nishikawa; Yukinori Andou, all of Nara; Toshio Yamanaka, Yao; Hideaki Kadowaki, Yamatokoriyama, all of Japan

[73] Assignee: Sharp Kabushiki Kaisha, Osaka, Japan

[21] Appl. No.: 561,001

[22] Filed: Nov. 21, 1995

[30] Foreign Application Priority Data

Nov. 30, 1994 [JP] Japan ..... 6-297057

[51] Int. Cl.[6] ..... G03G 15/06

[52] U.S. Cl. ..... 355/245; 355/260

[58] Field of Search ..... 355/245, 260; 222/DIG. 1

[56] References Cited

FOREIGN PATENT DOCUMENTS

| | | |
|---|---|---|
| 366113 | 5/1990 | European Pat. Off. . |
| 571136 | 11/1993 | European Pat. Off. . |
| 61-22366 | 1/1986 | Japan . |
| 513315 | 1/1986 | Japan . |
| 62-116970 | 5/1987 | Japan . |
| 62-283365 | 12/1987 | Japan . |
| 64-49944 | 3/1989 | Japan . |
| 3-075769 | 3/1991 | Japan . |
| 3-75769 | 3/1991 | Japan . |

*Primary Examiner*—Nestor R. Ramirez

[57] ABSTRACT

A developing unit includes a developing tank and a toner hopper. The developing tank is disposed to oppose a recording medium rotatably mounted to an image forming apparatus utilizing electrophotography. A developing member conveys a developer and attaches toner to an electrostatic latent image formed on the recording medium to develop the electrostatic latent image. The toner hopper has a toner supply port for supplying toner to the developing tank through a toner replenishing port formed in the developing tank. The developing tank is detachable in a direction of a rotating shaft of the recording medium, and is movable in a direction perpendicular to the direction of the rotating shaft of the recording medium so as to separate from or oppose the recording medium. The toner hopper has a shutter for opening/closing an opening of the toner supply port. A moving mechanism mounted on the developing tank simultaneously provides movement of the developing tank in the direction perpendicular to the direction of the rotating shaft of the recording medium and movement of the toner hopper shutter to open/close the toner supply port when manipulated.

7 Claims, 8 Drawing Sheets

DEVELOPING UNIT HAVING INTERLOCKING MECHANISM

BACKGROUND OF THE INVENTION (1) Field of the Invention

The present invention relates to a developing unit for developing an electrostatic latent image formed on a recording medium and, more particularly, to a developing unit comprising a developing tank containing a developer and a toner hopper (toner supply portion) for supplying toner to the developing tank as required such that the developing tank and the toner hopper can be separated from each other, in which the developing tank is detachable.

(2) Description of the Prior Art

An image forming apparatus, e.g., a copying machine and a laser printer, utilizing electrophotography, has a developing unit which attaches toner comprising a coloring pigment to an electrostatic latent image formed on a photosensitive body serving as a recording medium, e.g., electrostatically, in order to visualize the electrostatic latent image.

The developing unit has a developing roller for conveying the developer to a developing area opposing the photosensitive body. The developer stored in the developing tank is attracted to the developing roller by a magnetic force, and is conveyed to the developing area of the photosensitive body. Usually, the developing unit uses a developing roller obtained by forming a non-magnetic cylindrical sleeve around a magnet so that the developing roller magnetically attracts the developer by the magnetic force. When the sleeve is rotated, the developer is magnetically attracted to the sleeve by the magnetic force of the magnet, and is conveyed to the developing area opposing the photosensitive body. A magnetic brush of the developer is formed at a portion of the photosensitive body corresponding to the magnetic pole of the magnet. The magnetic brush rubs against the photosensitive body, thereby developing an electrostatic latent image.

The magnetic brush type developing unit having the above arrangement uses, as the developer, a two-component developer consisting of carrier as a magnetic body and toner as a coloring agent, a mono component developer in which the toner itself contains a magnetic material, and the like.

Some developing units perform development by utilizing non-magnetic mono component toner without employing the magnetic brush phenomenon. In this developing unit, since the developing roller does not have a magnetic force, it cannot magnetically attract the toner. Instead, non-magnetic mono component toner is coated on the surface of the developing roller by using a coating member, and the toner is conveyed to a developing area opposing the photosensitive body by rotation of the developing roller. Since this toner does not contain a magnetic material, it is very advantageous when forming a color image.

The developing unit has a developing tank storing a developer and a toner hopper for supplying toner to the developing tank. The toner is supplied to the developing tank as required. More specifically, when the toner in the developing tank becomes short, the toner in the toner hopper is supplied to the developing tank. This is because the toner which is consumed by development must be supplied to the developing tank as required. The toner hopper stores a large amount of toner and supplies it to the developing tank. In order to replenish the toner from the toner hopper to the developing tank, the toner supply port of the toner hopper opposes the toner replenishing port formed in the upper portion of the developing tank.

Conventionally, a toner hopper and a developing tank are integrally provided. When the toner in the toner hopper and developing tank runs out, the entire developing unit is replaced with a new one. Since the developing unit is replaced only because the toner runs out regardless of the service life of the developing unit, it is economically very wasteful. Therefore, it has been proposed to make the toner hopper and the developing tank separate from each other, and to make only the developing tank detachable, so that the developing tank is replaced when its service life runs out. Alternatively, it has been proposed to simplify the maintenance procedure of the developing tank.

When the developing tank is to be separated from the toner hopper so that only the developing tank is mounted or detached, it is necessary to prevent the toner from scattering or dropping from the toner supply port of the toner hopper and the toner replenishing port of the developing tank. For this purpose, a shutter or the like is provided, so that the toner replenishing and supply ports are closed when mounting and detaching the developing tank.

For example, Japanese Patent Application Laid-open Hei 3 No. 75769 proposes a developing unit as shown in FIG. 11. A developing unit 100 of FIG. 11 is constituted by a developing tank 101 and a toner hopper 102. The developing tank 101 has a developing roller for conveying a predetermined amount of developer to a photosensitive body on which an electrostatic latent image is formed, thereby visualizing the electrostatic latent image. The toner hopper 102 is detachably provided to the developing tank 101 and replenishes toner. An opening/closing member 104 attached with a shutter 103 is rotatably axially supported by a support shaft 105 in the developing tank 101. When the opening/closing member 104 is operated, the shutter 103 closes or opens a toner replenishing port 101*a* of the developing tank 101 by the biasing force of a spring 106.

An opening lever 107 for opening the shutter 103 is fixed to the toner hopper 102. The distal end of the opening lever 107 opposes a projecting portion 108 integrally formed on the opening/closing member 104. In order to close the shutter 103, a closing lever 110 rotatably supported by a shaft portion 109 is further provided as part of the developing tank 101 such that it opposes the projecting portion 108. A pivot force in the counterclockwise direction normally acts on the closing lever 110 because of the biasing force of a spring (not shown).

Therefore, in the state shown in FIG. 11, in the process of mounting the toner hopper 102 from above, the opening lever 107 abuts against the projecting portion 108 to revolve the opening/closing member 104. The shutter 103 opens the toner replenishing port 101*a*, and the opening lever 107 stops upon abutting against the closing lever 110. When the toner hopper 102 is lifted upward, the closing lever 110 disconnected from the distal end of the opening lever 107 is revolved counterclockwise, and is engaged with a pin 111 fixed to the opening/closing member 104, thereby revolving the opening/closing member 104 counterclockwise against the biasing force of the spring 106. As a result, when the spring 106 moves over the support shaft 105 by the pivot movement of the opening/closing member 104, the spring 106 revolves the opening/closing member 104 in the closing direction. Thus, the shutter 103 closes the toner replenishing port 101*a*. This closing state is maintained by the biasing force of the spring 106. At this time, the pivot movement of the closing lever 110 is regulated by a stopper (not shown), so that it will not interfere with the shutter 103 that closes the toner replenishing port 101*a*.

Inversely, when mounting the toner hopper 102 to the developing tank 101, the opening lever 107 is revolved downward upon abutting against the projecting portion 108 of the opening/closing member 104, and then the shutter 103 revolves to open the toner replenishing port 101*a*. When the spring 106 is located below the support shaft 105 in FIG. 11, the spring 106 serves as an opening biasing force for rotating the opening/closing member 104 clockwise. Thus, as shown in FIG. 11, when a supply port 102*a* of the toner hopper 102 and the toner replenishing port 101*a* coincide, the closing lever 110 abuts against the opening lever 107, so that the projecting portion 108 is separated from the opening lever 107. Note that reference numeral 112 denotes a supply roller provided along the toner supply port 102*a*. The toner is supplied upon rotation of the supply roller 112.

In the developing unit having the above arrangement, when the toner hopper 102 is removed upward, the developing tank 101 can be removed from the main body of the copying apparatus.

In the conventional developing unit 100 shown in FIG. 11, since the toner replenishing port 101*a* of the developing tank 101 is closed with the shutter 103, the toner will not drop when extracting the developing tank 101. However, before extracting the developing tank 101, the toner hopper 102 must be lifted upward. Then, the toner attaching to a portion near the toner supply port 102*a* sometimes leaks to drop or scatter.

Furthermore, to extract the developing tank without touching a photosensitive body, the developing tank must be moved in a direction perpendicular to the direction of the rotating shaft of the photosensitive body and be separated from the photosensitive body so that the surface of the photosensitive body will not be damaged. For this reason, while separating the developing tank from the photosensitive body, the toner supply port of the toner hopper and the toner replenishing port of the developing tank sometimes rub against each other, thus scattering or dropping the toner. When separating the developing tank from the photosensitive body and extracting the developing tank, the toner replenishing port and the toner supply port only shift laterally relative to each other and are not disconnected from each other. Then, the toner scatters or drops often due to vibration occurring when the toner replenishing port and the toner supply port rub against each other. In this case, even if the toner replenishing port and the toner supply port are slightly separated from each other, they may come into contact with each other due to vibration occurring during extraction of the developing tank, and the toner sometimes scatters from the toner supply port.

In Japanese Patent Publication Hei 5 No. 13315, a developing tank is pivotally provided so that it can be separated from a photosensitive body. The developing tank is mounted or detached while it is separated from the photosensitive body. In this case, while mounting the developing tank, a shutter closing the toner replenishing port of the developing tank is opened in an interlocking manner with the mounting operation, and the toner supply port of a toner hopper and the toner replenishing port of the developing tank are coupled to each other with a bellows-type coupling member fixed to the developing tank. This coupling member is housed in the shutter mechanism of the developing tank. When the shutter is opened upon mounting the developing tank, as the coupling member is constantly biased in a direction to couple the toner replenishing port and the toner supply port, they are coupled. When this coupling operation is completed, the developing tank is revolved toward the photosensitive body and is thus positioned in the developing state.

With this arrangement, since the toner supply port of the toner hopper and the toner replenishing port of the developing tank are coupled with each other in an interlocking manner with the mounting operation of the developing tank, when mounting the developing tank, the shutter provided as part of the toner hopper is opened, without any problem, in an interlocking manner with the mounting operation. Thus, toner leakage and the like can be prevented.

When, however, extracting the developing tank, the developing tank-extracting operation must be started only after the developing tank is separated from the photosensitive body. Otherwise, the shutter of the toner hopper is not closed, so that the toner cannot be prevented from dropping or scattering due to vibration occurring during the extraction. Furthermore, since the member that couples the toner supply port and the toner replenishing port is constantly biased to seal them, no means is available for separating the toner replenishing port and the toner supply port. This makes the extracting operation very difficult. In particular, since the coupling member is housed in the shutter of the developing tank, the toner attached to a portion near the shutter soils an operator's hand, and also a very cumbersome extracting operation is required. If the operator forgets to house the coupling member, extraction of the developing tank is interfered and thus the tank cannot be extracted.

As described above, although the developing tank can be mounted and detached after it is separated from the photosensitive body, the mounting/detaching operation of the developing tank, particularly the detaching operation, is very cumbersome. Since the coupling member is coupled to the toner supply port of the toner hopper in an interlocked manner with the mounting/detaching operation, or is separated from the toner supply port of the toner hopper manually, toner contamination caused by the toner that scatters or drops due to vibration occurring during the coupling or separating operation cannot be prevented.

SUMMARY OF THE INVENTION

The present invention has been achieved in view of the above problems, and has an object to provide a developing unit free from the fear of toner scattering, dropping, and the like during the mounting/detaching operation of the developing tank. In particular, it is an object of the present invention to provide a developing unit in which the toner supply port of the toner hopper is closed when the developing tank is separated from or opposes the photosensitive body, so that the mounting/detaching operation of the developing tank is very simplified, and dropping or scattering of any toner attached to the toner supply port can be prevented during mounting/removing the developing tank.

According to an aspect of the present invention, there is provided a developing unit which comprises: a developing tank disposed to oppose a recording medium which is rotatably mounted to an image forming apparatus utilizing electrophotography and having a developing member which conveys a developer and attaches toner to an electrostatic latent image formed on the recording medium to develop the electrostatic latent image; and a toner hopper having a toner supply port for supplying the toner to the developing tank through a toner replenishing port formed in the developing tank, wherein the developing tank is detachable in a direction of a rotating shaft of the recording medium and is movable in a direction perpendicular to the direction of the rotating shaft of the recording medium so as to separate from or oppose the recording medium, the toner hopper has a shutter for opening/closing an opening of the toner supply port, and the image forming apparatus is provided with an interlocking mechanism which disconnects or connects the toner replenishing port and the toner supply port in an interlocking manner with an operation of moving the developing tank to separate from or to oppose the recording medium and which simultaneously operates the shutter to close or open the opening of the toner supply port.

According to the developing unit of the present invention, when the developing tank is to be extracted from the body of the image forming apparatus for the purpose of replacement or maintenance, first, the developing tank is moved in a direction to separate from the photosensitive body serving as the recording medium, i.e., in a direction perpendicular to a direction of the rotating shaft of the photosensitive body. The shutter closes the toner supply port of the toner hopper in an interlocking manner with this separating movement. Thus, dropping of the toner from the toner hopper can be prevented. In this state, the developing tank is extracted from the body of the image forming apparatus. This extracting operation is performed in a state that the developing tank is separated from the photosensitive body in the direction of the rotating shaft of the photosensitive body. In particular, since the closing operation of the shutter is interlocked with the operation of separating the developing tank from the photosensitive body, an extra operation of closing the toner supply port with the shutter becomes unnecessary.

In the present invention, a state wherein the developing tank opposes the recording medium means a state wherein the developing tank and the recording medium are close to each other.

It is effective to incline the distal ends of the toner replenishing port and the toner supply port upward in a direction along which the developing tank separates from the recording medium. Then, when the developing tank is separated from the photosensitive body, the toner supply port and replenishing port are separated from each other without rubbing. Vibration is thus suppressed from occurring during this separation, and the toner attaching to the toner supply port can be prevented from dropping or scattering.

It is effective to provide a seal member made of an elastic material to the distal end of the toner replenishing port. In this case, a better seal can be provided between the toner replenishing port and the toner supply port due to elastic deformation, so that toner scattering and the like occurring during mounting of the developing tank can be prevented as much as possible. Since a good seal is assured, the toner will not scatter at all during the toner supply operation.

It is also effective to set the diameter of the toner replenishing port such that the toner supply port falls within the range of the toner replenishing port when the toner replenishing port and the toner supply port are disconnected from each other. Thus, if the diameter of the toner supply port is set smaller than that of the toner replenishing port, i.e., if the diameter of the toner replenishing port is set larger than that of the toner supply port, the toner supply port can be located within the accommodation range of the toner replenishing port even if the toner supply port and toner replenishing port are disconnected from each other upon movement of the developing tank, so that any toner which drops naturally can be completely recovered even when the developing tank is separated. Therefore, the interior of the apparatus will not be contaminated with the dropping or scattering toner. Hence, replacement of the developing tank can be performed easily without contaminating the hand and the like of a user or a service engineer attending the apparatus for maintenance.

Further advantages and features of the invention as well as the scope, nature and utilization of the invention will become apparent to those skilled in the art from the description of the preferred embodiments of the invention set forth below.

BRIEF DESCRIPTION OF THE DRAWINGS

FIGS. 6A and 6B show an embodiment of a shutter which opens/closes the toner supply port of the toner hopper according to the present invention, wherein FIG. 6A is a plan view, and FIG. 6B is a side view;

FIGS. 7A and 7B show the moving mechanism of the developing tank and an interlocking mechanism for opening/closing the shutter according to the present invention, wherein FIG. 7A is a plan view, and FIG. 7B is a side view;

DESCRIPTION OF THE PREFERRED EMBODIMENTS

An embodiment of the present invention will be described with reference to FIGS. 1 to 5 as follows.

Figure 1:
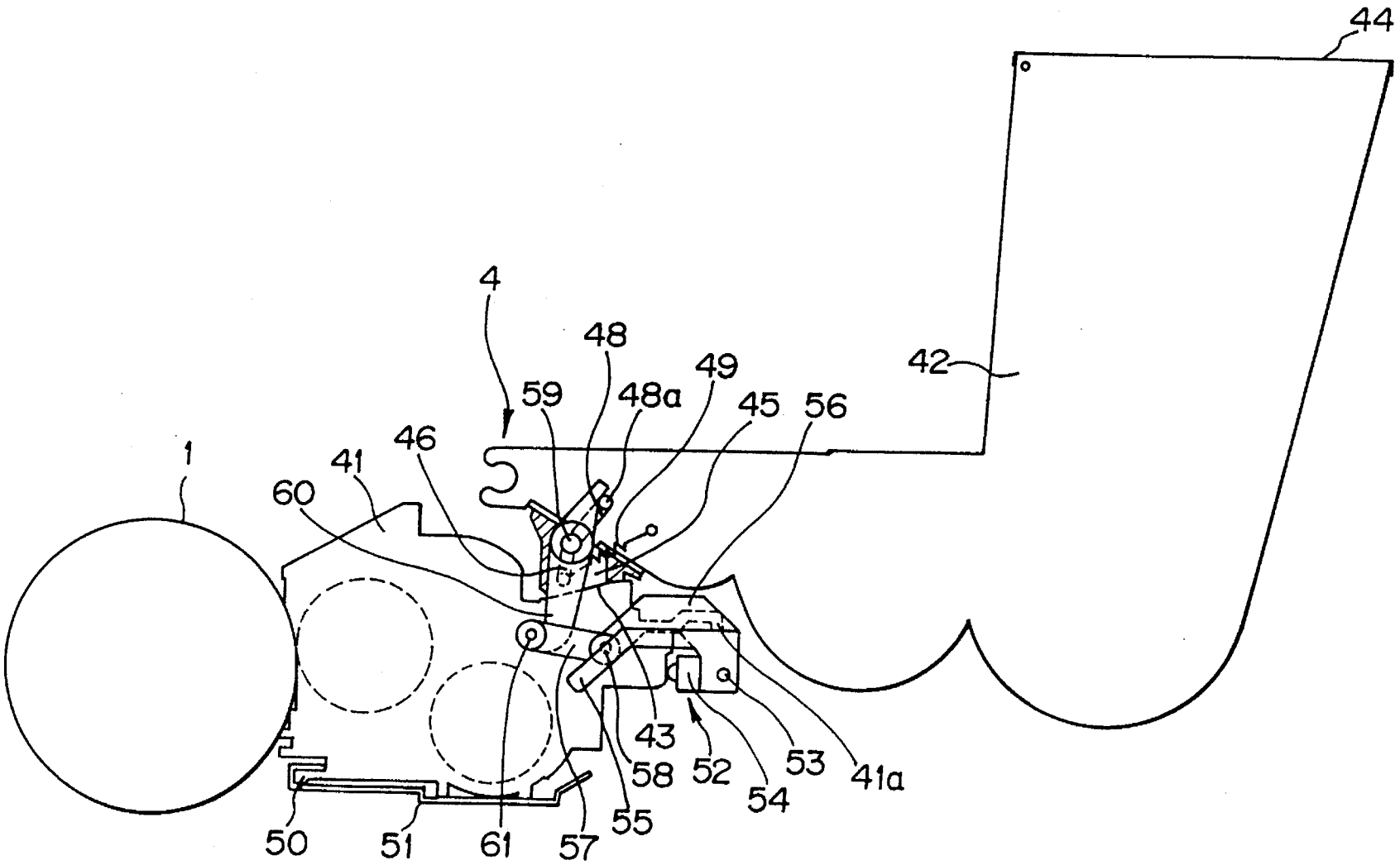
FIG. 1 is a partially sectional side view showing an embodiment of a developing unit according to the present invention, in which the developing tank is positioned at a developing position where it opposes the photosensitive body.
Figure 2:
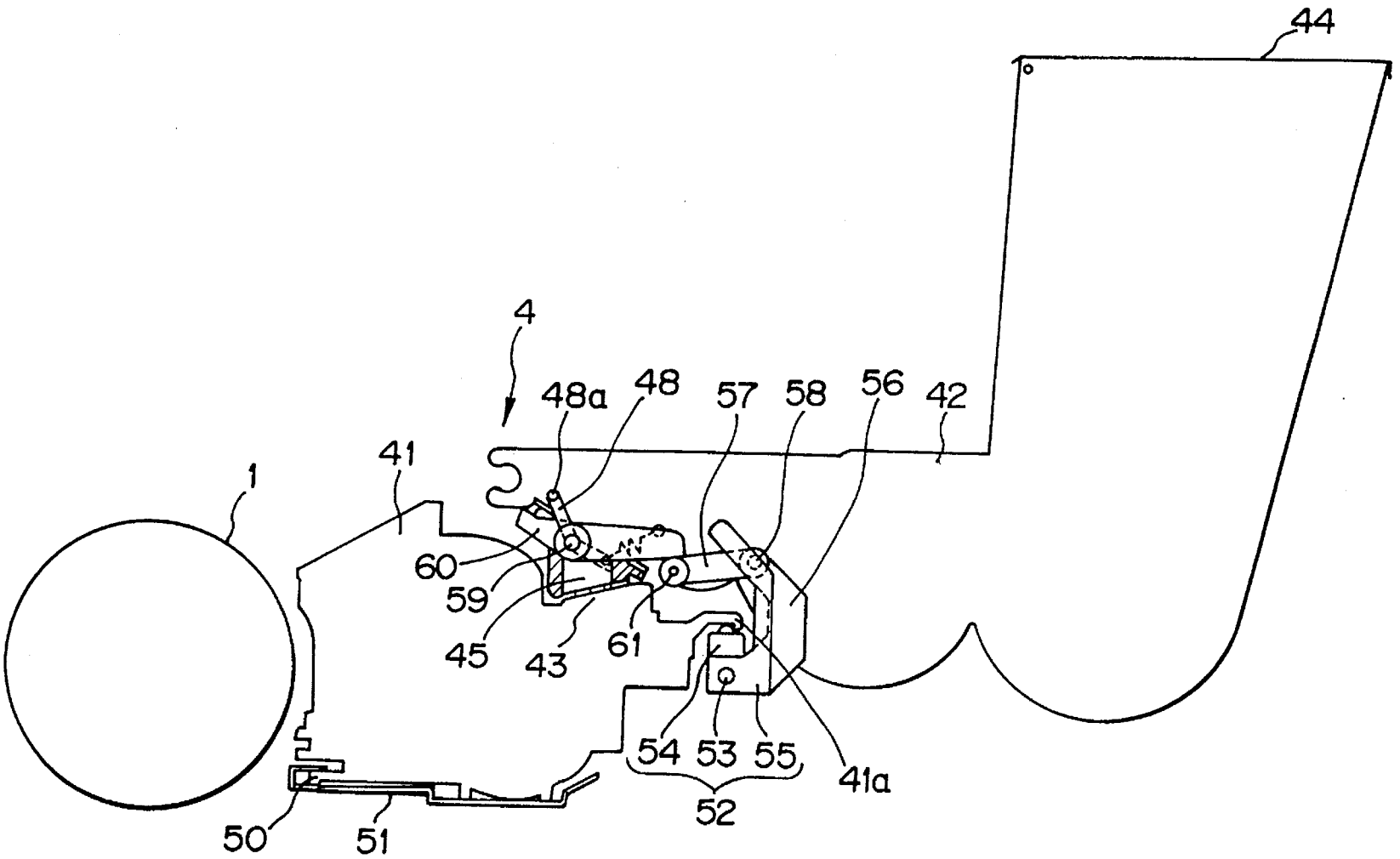
FIG. 2 is a partially sectional side view of the developing unit of the present invention related to FIG. 1, in which the developing tank is separated from the photosensitive body.
Figure 3:
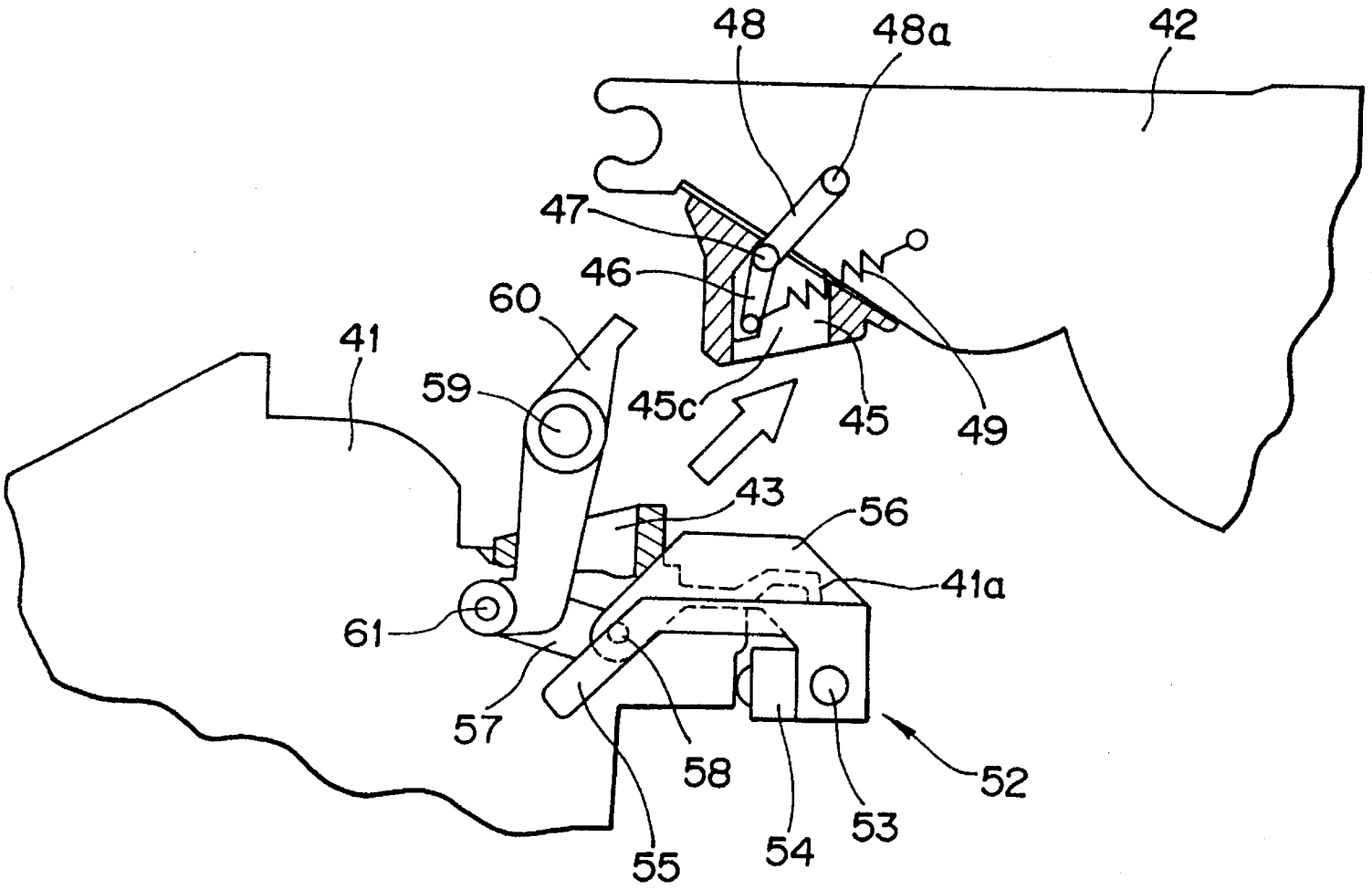
FIG. 3 is a side view of the main part of the developing unit of the present invention, in which the developing tank and the toner hopper shown in FIG. 1 are separated from each other.
Figure 4:
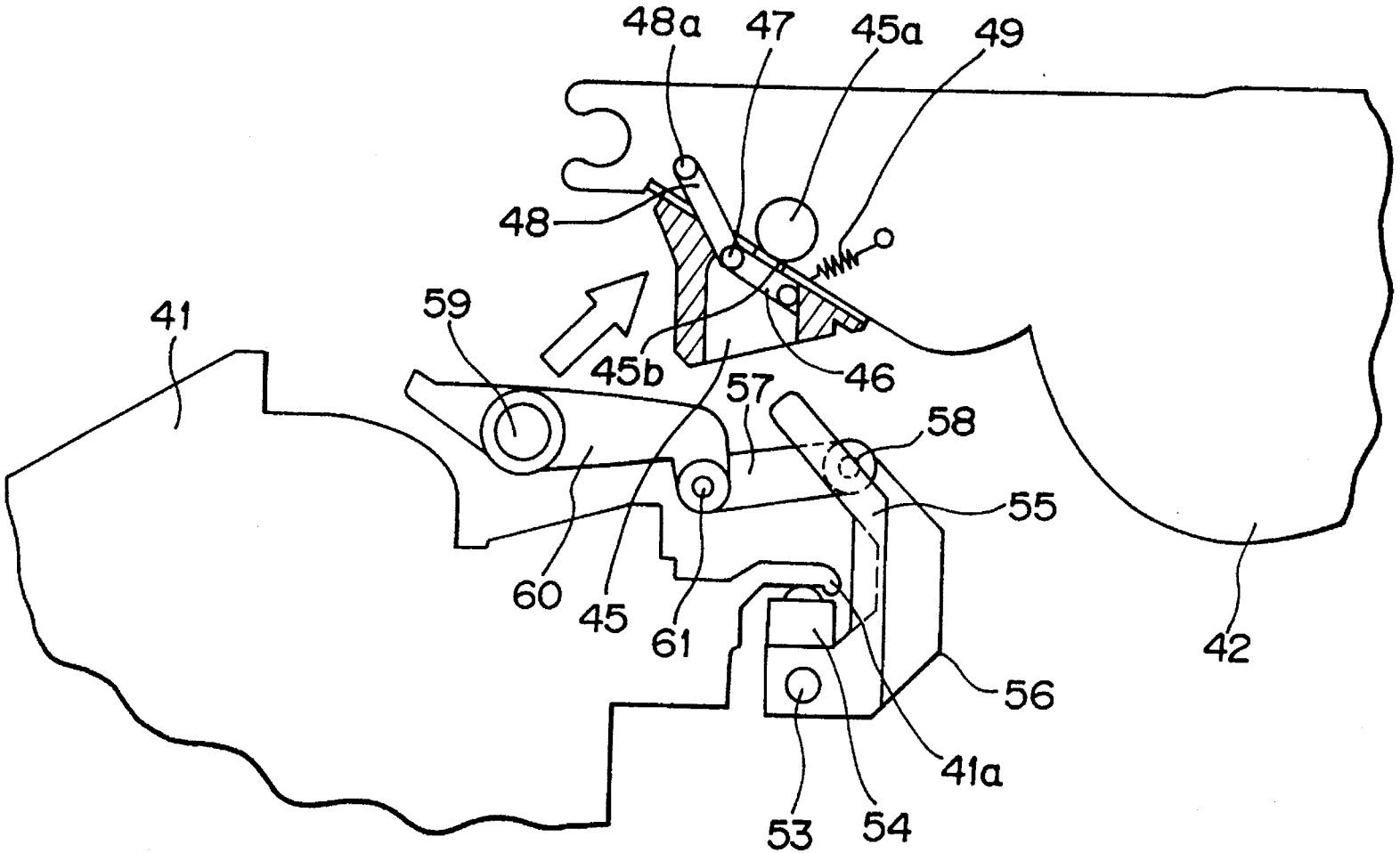
FIG. 4 is a side view of the main part of the developing unit of the present invention, in which the developing tank and the toner hopper shown in FIG. 2 are separated from each other.

FIGS. 1 and 2 show an embodiment of a developing unit utilized in an image forming apparatus employing electrophotography according to the present invention. FIGS. 3 and 4 are detailed views showing the relationship between a developing tank and a toner hopper during mounting and detachment of the developing tank of the present invention. In FIGS. 3 and 4, the developing tank and the toner hopper are separated for the convenience of easy understanding.

Figure 5:
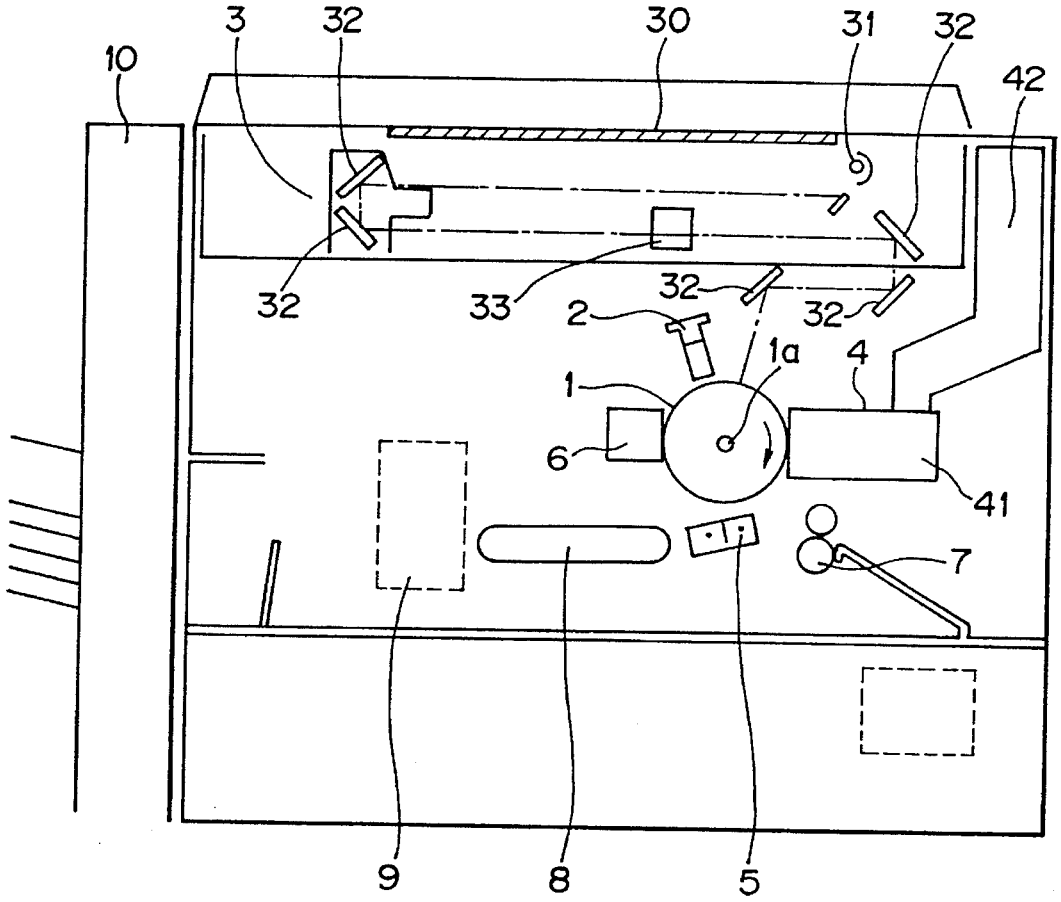
FIG. 5 is a schematic sectional view showing the arrangement of an entire copying apparatus in which the developing unit according to the present invention is provided.

FIG. 5 is a sectional view of a copying apparatus in which the developing unit of the present invention is applied to the copying apparatus serving as an image forming apparatus.

Referring to FIG. 5, reference numeral 1 denotes a photosensitive body having a photoconductive layer formed into a cylinder (drum) and serving as a recording medium. When forming an image, the photosensitive body 1 is rotated around a rotating shaft la as the center at a predetermined speed in a direction indicated by an arrow. Various types of units for image formation are arranged around the photosensitive body 1.

In FIG. 5, reference numeral 2 denotes a charging unit for uniformly charging the surface of the photosensitive body 1; 3, an optical system for irradiating an optical image onto the surface of the charged photosensitive body 1; 4, a developing unit of the present invention for visualizing an electrostatic latent image formed on the surface of the photosensitive body 1; 5, a transfer unit for transferring a developed image, i.e., a toner image, onto a sheet of paper which is conveyed as required; and 6, a cleaning unit for removing the toner remaining after transfer from the surface of the photosensitive body 1 in order to prepare for subsequent image formation.

The optical system 3 serves to form an image of an original placed on a transparent original table 30 onto the surface of the photosensitive body 1, and is constituted by a lamp 31 for illuminating the original, a plurality of reflecting mirrors 32 for forming an optical path along which light reflected by the original is guided to the photosensitive body 1, and an imaging lens 33 arranged in the optical path to form an image of the original on the surface of the photosensitive body 1. When the image is formed on the surface of the photosensitive body 1 by the optical system 3, an electrostatic latent image is formed by electric charges according to the optical image of the original. Toner is attached to the electrostatic latent image by the subsequent developing unit 4, thereby developing the image.

The image formed in the above manner, i.e., the toner image, is electrostatically transferred onto paper supplied from a paper feed unit (not shown) as required and conveyed through registration rollers 7 by the operation of the transfer unit 5. This paper is separated from the photosensitive body 1, is conveyed on a conveyer belt 8 by a suction force, is passed through a fixing unit 9, and is conveyed outside the image forming apparatus.

A paper post-treating unit 10 is arranged outside the main body of the copying apparatus which is the image forming apparatus. An example of the post-treating unit 10 includes a sorter for sorting copied sheets, a stapler for stapling a required number of copied sheets, a puncher for punching holes at predetermined portions of the sheets, and the like.

The developing unit 4 used in the image forming apparatus having the above arrangement has, as shown in, e.g., FIGS. 1 and 2, a developing roller (indicated by a broken line) which attracts a stored developer on its circumferential surface by the magnetic force in the developing tank 41 for storing the developer consisting of carrier and toner. The developing unit 4 has a toner hopper 42 for replenishing the toner as required into the developing tank 41. The toner hopper 42 can be separated from the developing tank 41.

A toner replenishing port 43 is formed in the developing tank 41 at a position opposing a toner supply port 45 formed in the toner hopper 42. The toner supplied from the toner hopper 42 is stored in the developing tank 41 through the toner replenishing port 43. A conveying member (not shown) is rotatably provided in the developing tank 41 to oppose the toner replenishing port 43. The conveying member agitates the replenished toner and conveys it toward the axial direction so that the toner is uniformly replenished in the entire range of the rotating shaft of the developing roller in the developing tank 41.

The toner hopper 42 is provided with a lid 44 which can be opened/closed. The toner is replenished from above the lid 44. When replenishing the toner into the toner hopper 42, the lid 44 is opened. A plurality of agitating members, a conveying member, and a supply roller are rotatably provided in the toner hopper 42. The plurality of the agitating members agitate the stored toner. The conveying member conveys the agitated toner to the toner supply port 45. The supply roller is provided at the position of the toner supply port 45 and supplies the toner to the developing tank 41 through the toner supply port 45. At the position of the toner hopper 42 where the supply roller is provided, the toner supply port 45 corresponding to the toner replenishing port 43 of the developing tank 41 described above is provided. The toner supply roller is denoted by reference symbol **45*a*** in FIG. 4.

As shown in FIGS. 3 and 4, a shutter 46 which shields the toner supply port 45 from the outside when mounting or detaching the toner hopper 42 on or from the developing tank 41 is provided as part of the toner supply port 45. The shutter 46 is naturally larger than an opening **45*b* of the toner supply port 45 so that it can close the opening 45*b*, and can be rotated by a shaft portion 47 integrally formed with it. An opening/closing lever 48 for opening/closing the shutter 46 is integrally formed at a portion opposite to the shaft portion 47 of the shutter 46. The shutter 46 is provided with a spring 49 for normally biasing the shutter 46 in a direction to close the opening 45*b* of the toner supply port 45. In this embodiment, one end of the spring 49 is fixed to one end of the shutter 46, and the other end of the spring 49 is fixed to the toner hopper 42. Thus, the shutter 46 is normally biased in the direction to close the opening 45*b* of the toner supply port 45. Another spring 49 may also be provided at the opposite end portion of the shutter 46 in order to close the shutter 46**.

Figure 6B:
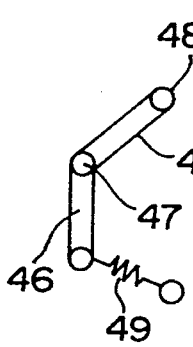
Figure 6A:
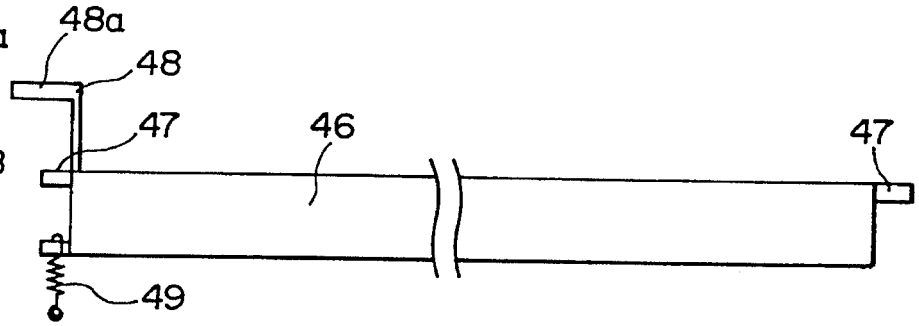

The shaft portion 47 and the opening/closing lever 48 are integrally formed with the shutter 46, as shown in FIGS. 6A and 6B. The shaft portion 47 is rotatably held by a side plate **45*c* (see FIG. 3) of the toner supply port 45, and the spring(s) 49 is (are) provided to one or two ends of the shutter 46. The opening/closing lever 48 is coupled to one end portion of the shutter 46, and is provided with a coupling pin 48*a* which engages with the opening/closing lever 48 and opens/closes the shutter 46**.

For the purpose of detachably providing the developing tank 41 to the main body of the copying apparatus serving as the image forming apparatus, a guided member 50 is provided at the bottom portion of the developing tank 41, as shown in FIGS. 1 and 2. The guided member 50 is guided by a guide 51 provided to the apparatus body. The developing tank 41 is movable between the developing position where it opposes the photosensitive body 1 and a separate position (mounting/detaching position) where it separates from the photosensitive body 1. The moving direction of the developing tank 41 is right-to-left on the guide 51 of FIG. 1.

A moving mechanism 52 is provided in order to enable the developing tank 41 to move in a direction perpendicular to a direction of the rotating shaft of the photosensitive body 1 (see FIGS. 3 and 4). In the moving mechanism 52, a press member 54 of the developing tank 41 is fixed to a rotating shaft 53 axially supported between the frames of the copying apparatus body, and an operation lever 55 for rotating the rotating shaft 53 by a manual operation is fixed to the rotating shaft 53 in the same manner. The operation lever 55 is provided at the front side so that it is exposed when the front cover of the copying apparatus body is opened.

When the operation lever 55 is rotated counterclockwise in FIG. 2 or 4, one side surface of the developing unit 4 opposite to the photosensitive body 1 is pressed to the left, so that the photosensitive body 1 comes close to the developing roller of the developing tank 41. At this time, positioning is performed so that the gap between the photosensitive body 1 and the developing roller is maintained at a predetermined value. For example, positioning is performed by pressing positioning-rotary collars provided at the two end portions of the rotating shaft of the developing roller against the two end portions of the photosensitive body 1 outside the image forming area. Inversely, when separating the developing tank 41 from the position where it opposes the photosensitive body 1, the operation lever 55 is rotated clockwise in FIGS. 1 and 3, thereby releasing pressure on the developing tank 41 caused by the press member 54. Simultaneously, a pawl 41*a* of the developing tank 41 which is provided to correspond to the distal end of the press member 54 is caught by the distal end of the press member 54 and moves the developing tank 41 to the right in FIGS. 1 and 3. In place of this, the developing tank 41 may be moved to the right by a spring (not shown) serving as a biasing means when pressure due to the press member 54 is released. In this state, the developing tank 41 can be extracted from the copying apparatus body in the direction of the rotating shaft 1*a* of the photosensitive body 1 and can be replaced.

Movement of the developing tank 41 toward the photosensitive body 1 to the state shown in FIG. 1 becomes possible when the developing tank 41 is completely inserted in the copying apparatus body. For this purpose, the guide 51 and the guided member 50 are formed into such shape that they can be moved only when insertion of the developing tank 41 deep into the copying apparatus body is completed.

The moving mechanism 52 is provided with an interlocking mechanism which opens/closes the shutter 46 of the toner hopper 42 by an operation interlocked with the operation of the moving mechanism 52. In this interlocking mechanism, one end of a coupling portion 56 of a link member which moves integrally with the operation lever 55 fixed to the rotating shaft 53 and one end of a link 57 are rotatably coupled to each other through a shaft pin 58, and the other end of the link 57 and one end of an opening/closing operation segment 60 which is rotatably, axially supported by a shaft 59 fixed to the frames of the copying apparatus body are rotatably supported by a shaft pin 61. When the operation lever 55 is rotated clockwise, the final opening/closing operation segment 60 is rotated counterclockwise. An end portion of the opening/closing operation segment 60 opposite to its axially supported portion is engaged with the coupling pin 48*a* of the opening/closing lever 48 of the shutter 46.

From the foregoing, when the operation lever 55 is rotated counterclockwise, this rotation is transmitted to the opening/closing operation segment 60 through the coupling portion 56 and the link 57, so that the opening/closing operation segment 60 is rotated clockwise about the shaft 59 as the center. Therefore, the opening/closing lever 48 is rotated clockwise about the shaft portion 47 as the center through the coupling pin 48*a* engaged with one end of the opening/closing operation segment 60. This rotation is in a direction to open the shutter 46 against the biasing force of the spring 49, and opens the shutter 46 to cancel the closed state of the opening 45*b*, thereby enabling toner supply. Inversely, when the operation lever 55 is rotated clockwise, the opening/closing operation segment 60 is rotated counterclockwise, so that the shutter 46 is rotated by the biasing force of the spring 49 in a direction to close the opening 45*b*.

To extract the developing tank 41 from the copying apparatus body, the front cover at the front surface of the copying apparatus body is opened. By this opening operation, the developing tank 41 and the toner hopper 42 become visible, and operation of the operation lever 55 is enabled. More specifically, the operation lever 55 is arranged at the front surface side of the copying apparatus body, and is exposed upon opening the front cover. In this state, when the operation lever 55 is manually rotated clockwise in FIG. 1, the pressure of the developing tank 41 acting on the photosensitive body 1 is released. When this rotation operation is continued, the distal end portion of the press member 54 abuts against the pawl 41*a* of the developing tank 41, and the developing tank 41 moves in a direction opposite to the direction to oppose the photosensitive body 1, i.e., in a separating direction perpendicular to the rotating shaft 1*a* of the photosensitive body 1, as shown in FIG. 2.

Simultaneously with the moving operation of the developing tank 41, the opening/closing operation segment 60 is rotated counterclockwise through the coupling portion 56 and the link 57. Thus, the clockwise rotation force of the opening/closing lever 48 is canceled, and the shutter 46 closes the opening 45*b* with the biasing force of the spring 49.

As described above, the opening 45*b* of the toner supply port 45 from which the toner is supplied to the toner replenishing port of the developing tank 41 is closed with the shutter 46 by the operation of separating the developing tank 41 from the photosensitive body 1, which is a pre-operation for extracting the developing tank 41. Accordingly, when extracting the developing tank 41 along the guide 51, the toner will not drop or scatter from the toner supply port 45 by the vibration caused by extraction, and will not soil the hand of the user or a maintenance service engineer, and the like with the toner. Furthermore, the developing tank 41 can be extracted once the operation of separating the developing tank 41 is completed, and another operation of closing the shutter 46 or the like is not needed.

When a new developing tank 41 is to be mounted to the copying apparatus body upon completion of the maintenance of the developing tank 41 or in order to replace the developing tank 41, while the front cover of the copying apparatus body is opened, the guided member 50 of the developing tank 41 is set to coincide with the guide 51, and the pawl 41*a* of the developing tank 41 is placed to coincide with the distal end of the press member 54. In this state, the developing tank 41 is pushed deep into the apparatus body. When the developing tank 41 cannot be further pushed into the apparatus body, movement of the developing tank 41 to the developing position where the developing tank 41 opposes the photosensitive body 1 is enabled. Thus, the operation lever 55 is rotated counterclockwise in FIG. 2.

By this operation, the rear surface of the developing tank 41 is pushed by the press member 54 to move toward the photosensitive body 1, and the gap between the developing roller of the developing tank 41 and the photosensitive body 1 is finally set at a predetermined value. At this time, when the opening/closing operation segment 60 is rotated clockwise simultaneously to engage with the opening/closing lever 48 and to rotate it clockwise, the shutter 46 is rotated against the biasing force of the spring 49. Accordingly, the shutter 46 opens the opening 45*b* of the toner hopper 42, thus enabling development by the developing tank 41.

As described above, when the developing tank 41 is inserted and the operation of positioning the developing tank 41 with respect to the photosensitive body 1 by the operation lever 55 is completed, the opening 45*b* for toner supply is also opened, and no special operation is needed. Since the opening 45*b* and the like are closed during mounting, the fear of toner dropping or toner scattering is eliminated.

Figure 7B:
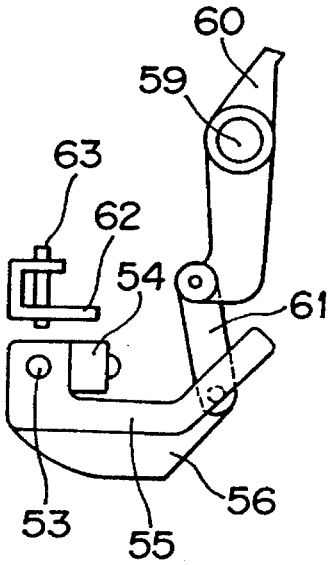
Figure 7A:
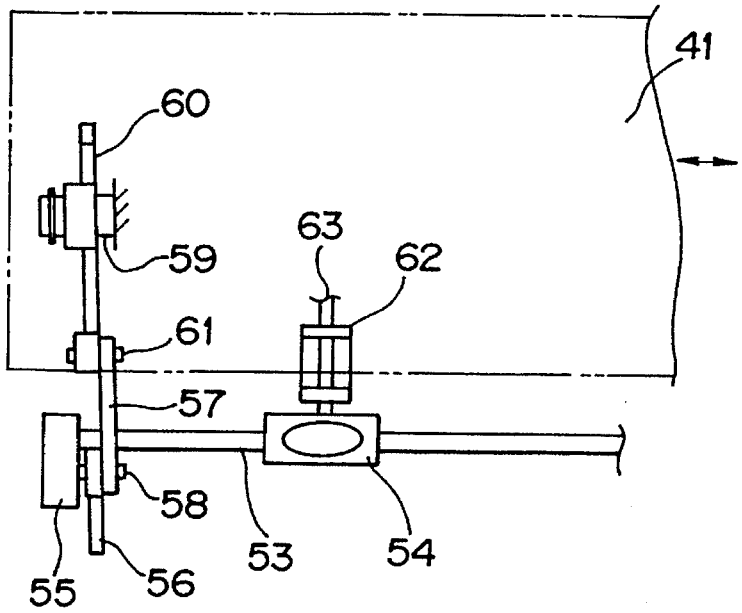
Figure 8:
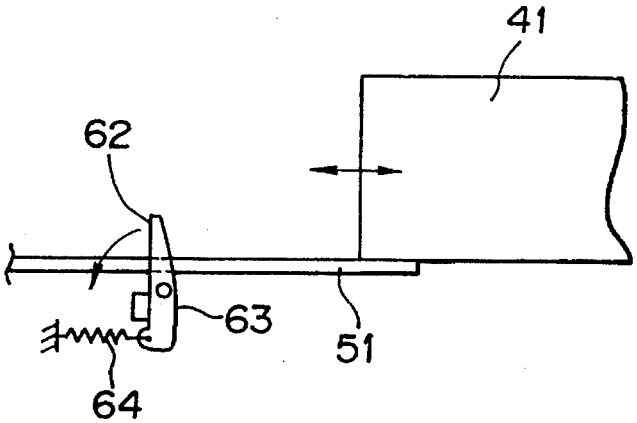
FIG. 8 is a front view showing a mounting/detaching state of the developing tank of the present invention.

When extracting the developing tank 41 and mounting it again, if the operation lever 55 is rotated clockwise by accident, the developing tank 41 cannot be mounted. In order to prevent this, a lock mechanism for the operation lever 55 may be preferably provided. In this lock mechanism, as shown in FIGS. 7A and 7B, a pivot regulating member 62 is provided at a portion to oppose the press member 54 such that it is axially supported in a direction perpendicular to the rotating shaft 53 of the press member 54. As shown in FIG. 8, this pivot regulating member 62 is biased to revolve about an axial support portion 63 as the center upon movement of the developing tank 41 in the direction of extraction or insertion of the developing tank 41, i.e., toward the rotating shaft 53. Accordingly, upon insertion of the developing tank 41, the pivot regulating member 62 is rotated against the biasing force of a spring 64 serving as a biasing means and thus does not interfere with insertion of the developing tank 41. Upon extraction of the developing tank 41, the pivot regulating member 62 is restored by the restoring force of the spring 64. Thus, as shown in FIGS. 7A and 7B, when the developing tank 41 is extracted, the rotation movement of the press member 54 is regulated, so that operation of the operation lever 55 is disabled, and mounting of the developing tank 41 is enabled at any time.

According to the present invention, the developing tank 41 is extracted when it is moved in the direction to separate from the photosensitive body 1, and is also allowed to be inserted. At this time, if the toner replenishing port 43 of the developing tank 41 and the toner supply port 45 of the toner hopper 42 coincide with each other, any toner attached to a portion near the upper toner supply port 45 may scatter or drop due to rubbing upon extraction or insertion of the developing tank 41, separation of the developing tank 41 from the photosensitive body 1, or while the developing tank 41 opposes the photosensitive body 1.

Figure 9:
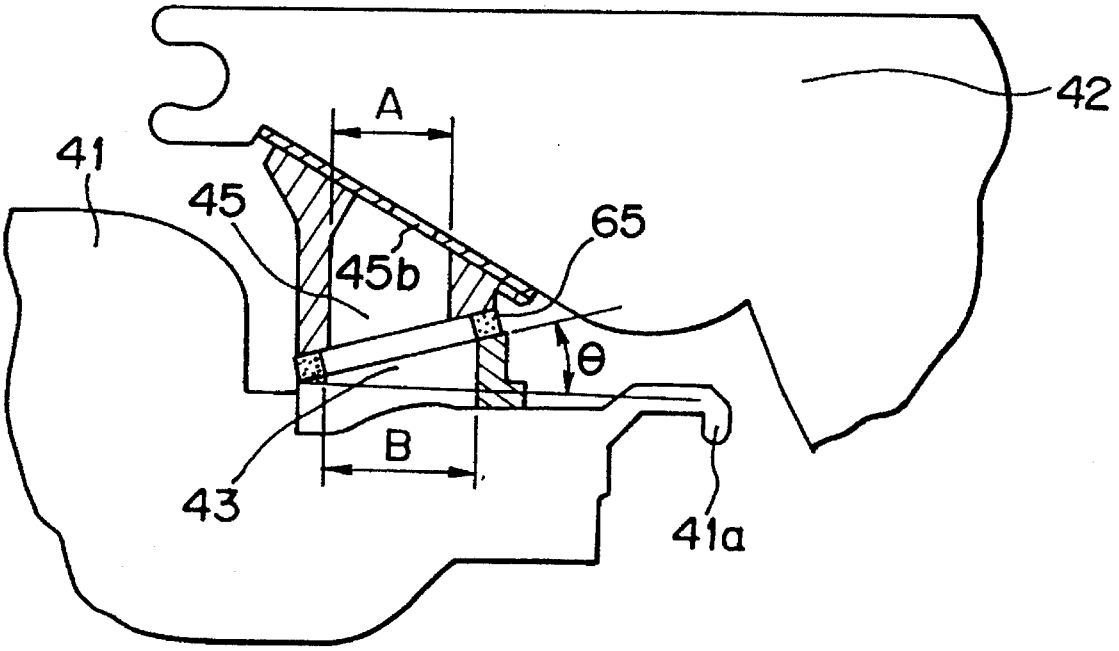
FIG. 9 is a sectional view showing the relationship between the toner replenishing port and the toner supply port of the present invention, illustrating an embodiment of the sealed state between these ports.

Therefore, in the present invention, as shown in FIG. 9, the toner supply port 45 of the toner hopper 42 and the toner replenishing port 43 of the developing tank 41 are formed to be inclined with respect to each other. The direction of this inclination is set to be higher in the moving direction along which the developing tank 41 separates from the photosensitive body 1. More specifically, the toner replenishing port 43 is formed to be inclined such that its end edge is gradually raised in the rightward moving direction of the developing tank 41 in FIG. 9, and the toner supply port 45 is formed to be inclined such that its end edge is gradually raised to coincide with the inclination of the toner replenishing port 43.

With this shape, when the developing tank 41 is moved in a direction to separate from the photosensitive body 1, the toner replenishing port 43 and the toner supply port 45 are separated from each other without rubbing against each other. Hence, dropping or scattering of the toner due to vibration or the like can be effectively prevented. Furthermore, when the developing tank 41 is mounted and is moved to the developing position where it opposes the photosensitive body 1, the toner supply port 45 and the toner replenishing port 43 can be set to coincide with each other and can be brought into tight contact with each other without rubbing. Thus, the fear of toner scattering or dropping can be eliminated during mounting as well. At this time, even if the toner is supplied through the toner supply port 45, it will not drop from the gap between the toner supply port 45 and the toner replenishing port 43.

Regarding an angle θ of inclination of the toner replenishing port 43 and the toner supply port 45 shown in FIG. 9, the larger the angle θ, i.e., the larger the inclination of a side of the toner replenishing port 43 which is remote from the photosensitive body 1, the larger the separation gap between the toner replenishing port 43 and the toner supply port 45 even if the separating distance through which the developing tank 41 is moved away from the photosensitive body 1 is set the same, and the toner replenishing port 43 and the toner supply port 45 will not come into contact with each other by the vibration or the like upon mounting/detaching of the developing tank 41. If the angle of inclination is excessively large, however, the space taken up by the two ports 43 and 45 must be large. In other words, an extra space is required.

If the angle θ of inclination is decreased, although the spaces taken up by the two ports 43 and 45 can be decreased, the separation gap between the two ports 43 and 45 becomes narrow when separating the developing tank 41 from the photosensitive body 1. Thus, when mounting or detaching the developing tank 41, the two ports 43 and 45 rub against each other due to the vibration, thereby scattering the toner. Although the gap between the two ports 43 and 45 can be increased by increasing the separating distance of the developing tank 41 away from the photosensitive body 1, an extra space must be kept for movement.

As described above, when the angle θ of inclination is large, although the separating distance between the toner replenishing port 43 and the toner supply port 45 can be increased without increasing the moving distance of the developing tank 41 away from the photosensitive body 1, the problem of increased required space arises. When the angle θ of inclination is decreased, although the space taken up by the two ports 43 and 45 can be decreased, the moving distance of the developing tank 41 away from the photosensitive body 1 must be set large, which leads to the need for extra space. From these respects, the angle θ of inclination is preferably 20° to 60°, and is most effectively about 45°.

As shown in FIG. 9, in order to bring the toner replenishing port 43 and the toner supply port 45 in a more tight contact state, for example, a seal member 65 may be provided at the toner replenishing port 43. Then, toner scattering occurring upon connection of the toner replenishing port 43 and the toner supply port 45 and toner scattering occurring during toner replenishment can be eliminated.

Figure 10:
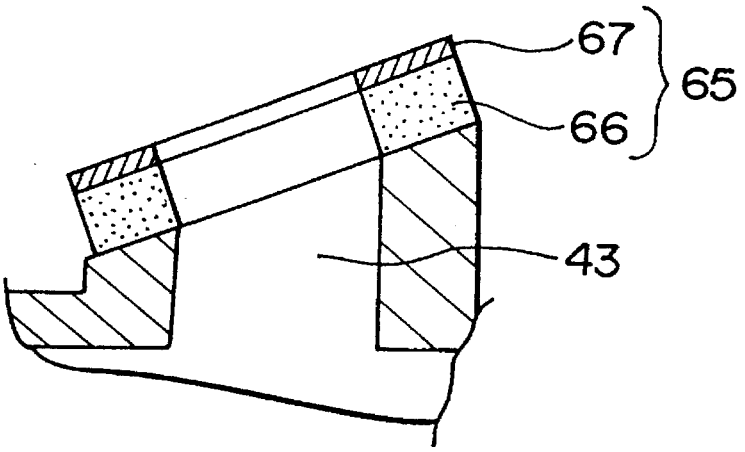
FIG. 10 is a sectional view showing an embodiment of a seal member which seals the toner replenishing port and the toner supply port according to the present invention.
Figure 11:
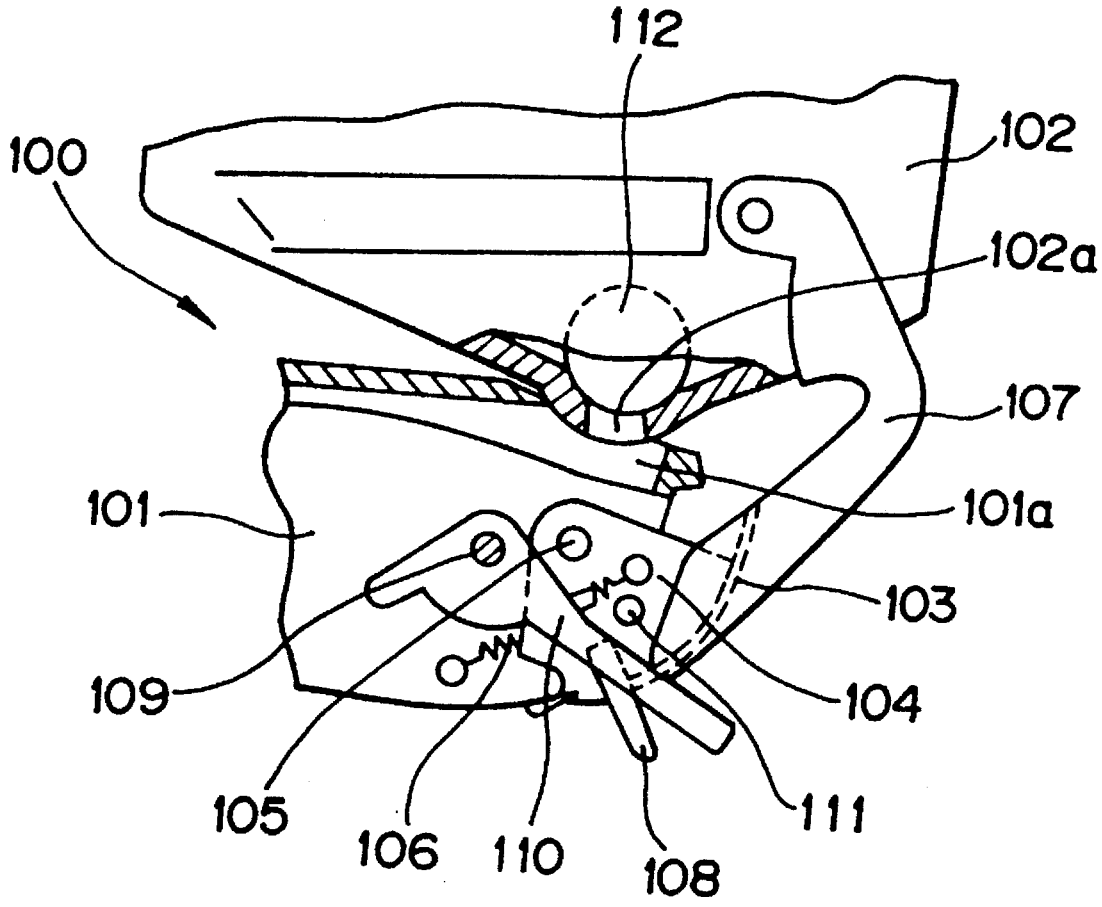
FIG. 11 PRIOR ART
FIG. 11 is a partly sectional side view of the arrangement of a conventional developing unit.

As shown in FIG. 10, the seal member 65 is obtained by fixing, to the peripheral portion of the toner replenishing port 43, a cushion member 66 made of an elastic material such as rubber (e.g., foamed polyurethane), and a seal material 67, e.g., a polyethylene terephthalate (PET) film or suede, is fixed on the cushion portion 66 with an adhesive.

With this arrangement, when the developing tank 41 is positioned with respect to the photosensitive body 1, the seal member 65 of the toner replenishing port 43 comes into tight contact with the toner supply port 45 of the toner hopper 42. In particularly, due to elastic deformation of the cushion member 66 serving as an elastic member, the upper toner supply port 45 is kept in tight contact with the seal material 67, thereby completely keeping the ports 43 and 45 in tight contact with each other. Thus, the toner supplied through the toner supply port 45 will not scatter or drop from the seal member 65 at all. In particular, since the toner replenishing port 43 and the toner supply port 45 are inclined, they can be connected to each other smoothly, and the toner will not scatter or drop during this connecting operation.

Furthermore, as shown in FIG. 9, regarding a size A of the opening portion of the toner supply port 45 and a size B of the opening portion of the toner replenishing port 43, the size B of the opening portion of the toner replenishing port 43 is set larger than the other (B>A). More specifically, the size B of the opening portion of the toner replenishing port 43 is set such that the opening portion of the toner supply port 45 is located inside the opening portion of the toner replenishing port 43 when the developing tank 41 is separated from the photosensitive body 1. Since the toner replenishing port 43 can cover the toner supply port 45, the opening portion of the toner replenishing port 43 is always located immediately under the toner supply port 45 when the developing tank 41 is separated, so that any toner attached to a portion near the toner supply port 45 can be recovered through the toner replenishing port 43.

A case wherein the developing unit is applied to a copying apparatus has been described above. Note that naturally the present invention can be similarly applied to any apparatuses that develop an electric formed image with toner. The developer is not limited to one constituted by carrier and toner, but the present invention can similarly be practiced with a developer constituted by only toner itself. In other words, the present invention also includes a case wherein toner is stored in a developing tank 41 and the toner is supplied to the developing tank 41 from a toner hopper 42 when the amount of toner stored in the developing tank 41 becomes equal to or smaller than a predetermined value, as a matter of course.

In addition, the toner is not limited to magnetic toner, but the object of the present invention can be achieved with the completely same arrangement that employs non-magnetic mono component toner. In other words, the present invention can be applied to any apparatuses without a change wherein non-magnetic toner is supplied from a toner hopper 42 to a developing tank 41 as required.

As described above, since the toner hopper 42 is held by the apparatus body and can be mounted on and detached from the developing tank 41, the toner hopper 42 can be arranged by utilizing a non-used space in the copying apparatus, thus enabling a large-volume toner hopper. Then, the toner replenishing operation can be suppressed as much as possible, and frequent toner replenishing operations can be avoided in high-speed copying.

According to the developing unit of the present invention, the developing tank can be separated from the toner hopper and can be detachably provided to the apparatus body. The arrangement of the developing unit is very simplified, and the toner of the toner hopper can be effectively prevented from scattering or dropping during the mounting or detachment of the developing tank.

Since the closing operation of the shutter and the separating operation of the toner replenishing port and toner supply port from each other can be performed simultaneously in an interlocking manner with the operation of moving the developing tank in a direction to separate it from the recording medium, these operations can be performed once and are simplified. Moreover, an adverse influence of vibration or the like can be prevented as much as possible upon connection or disconnection of the opening portions of the toner supply portion and toner replenishing portion. Also, toner scattering or dropping can be prevented more effectively without being influenced by other vibrations.

What is claimed is:

1. A developing unit, comprising:

a developing tank disposed to oppose a recording medium which is rotatably mounted on an image forming apparatus utilizing electrophotography and having a developing member which conveys a developer and attaches toner to an electrostatic latent image formed on said recording medium to develop the electrostatic latent image; and a toner hopper having a toner supply port for supplying the toner to said developing tank through a toner replenishing port formed in said developing tank, wherein said developing tank is detachable in a direction of a rotating shaft of said recording medium and is movable in a direction perpendicular to the direction of said rotating shaft of said recording medium so as to separate from or oppose said recording medium, said toner hopper having a shutter for opening/closing an opening of said toner supply port, and said image forming apparatus being provided with an interlocking mechanism which disconnects or connects said toner replenishing port and said toner supply port in an interlocking manner upon moving said developing tank to be separate from or to oppose said recording medium and which simultaneously operates said shutter to close or open the opening of said toner supply port.

2. The developing unit according to claim 1, wherein said interlocking mechanism is arranged such that said shutter opens or closes the opening of said toner supply port in an interlocking manner upon movement of an operation portion which moves said developing tank to a position to be separate from or to oppose said recording medium.

3. The developing unit according to claim 1, wherein said toner replenishing port and said toner supply port have distal ends inclining upward in a direction along which said developing tank separates from said recording medium.

4. The developing unit according to claim 3, wherein said distal end of said toner replenishing port has an angle of inclination which falls within a range of 20° to 60°.

5. The developing unit according to claim 1, wherein said toner replenishing port has a distal end having a seal member made of an elastic material.

6. The developing unit according to claim 3, wherein said distal end of said toner replenishing port has a seal member made of an elastic material.

7. The developing unit according to claim 1, wherein said toner replenishing port has a diameter such that said toner supply port falls within a range of said toner replenishing port when said toner replenishing port and said toner supply port are disconnected from each other.

* * * * *